US007650899B2

(12) United States Patent
Eastman, II et al.

(10) Patent No.: US 7,650,899 B2
(45) Date of Patent: Jan. 26, 2010

(54) UNIVERSAL 3-D CAMOUFLAGE STRIPS WITH NATURE EFFECTS, CAMOUFLAGE COVER FORMED THEREFROM, AND OUTDOOR ENCLOSURE INCORPORATING SAME

(75) Inventors: Robert Eastman, II, Grand Blanc, MI (US); Scott D. Lee, Lapeer, MI (US)

(73) Assignee: Eastman Holding Company, Flushing, MI (US)

( * ) Notice: Subject to any disclaimer, the term of this patent is extended or adjusted under 35 U.S.C. 154(b) by 430 days.

(21) Appl. No.: 11/319,993

(22) Filed: Dec. 28, 2005

(65) Prior Publication Data

US 2006/0096630 A1 May 11, 2006

Related U.S. Application Data

(63) Continuation-in-part of application No. 10/956,378, filed on Oct. 1, 2004, now abandoned.

(51) Int. Cl.
*E04H 15/32* (2006.01)

(52) U.S. Cl. ..... 135/120.1; 135/115; 135/901

(58) Field of Classification Search ..... 135/114, 135/115, 119, 120.1, 120.2, 901
See application file for complete search history.

(56) References Cited

U.S. PATENT DOCUMENTS 4,517,230 A 5/1985 Crawford
4,792,471 A 12/1988 Lee
5,377,711 A * 1/1995 Mueller ..... 135/87
5,477,875 A * 12/1995 Daly, Jr. ..... 135/95
6,009,673 A 1/2000 Adams
6,060,142 A 5/2000 Rossini
6,127,007 A * 10/2000 Cox et al. ..... 428/15
7,143,452 B1 * 12/2006 Rossini ..... 2/209.13

* cited by examiner

*Primary Examiner*—David Dunn
*Assistant Examiner*—Danielle Jackson
(74) *Attorney, Agent, or Firm*—Carrier, Blackman & Associates, P.C.; William D. Blackman; Joseph P. Carrier

(57) ABSTRACT

A camouflage cover for equipping an outdoor enclosure with three-dimensional nature effects includes a plurality of elongated nature-effect strands that drape over the enclosure in a substantially vertical arrangement. The vine-like nature-effect strands help conceal hard lines and corners of the enclosure structure. The cover may include adjustment straps that allow a single cover to adapt to a number of enclosure structures. The adjustment straps, where used, may include interwoven cords and cord locks for adjusting tension of the straps. The nature-effect strands may have different camouflage patterns so that an enclosure can have an appropriate camouflage scheme no matter what season or environment. Tiebacks may optionally be used to permit horizontal adjustment of the nature-effect strands, in order to prevent allow free access to windows and doorways. Auxiliary loops may also be provided to allow attachment of additional nature effects by a user.

18 Claims, 5 Drawing Sheets

FIG. 1B
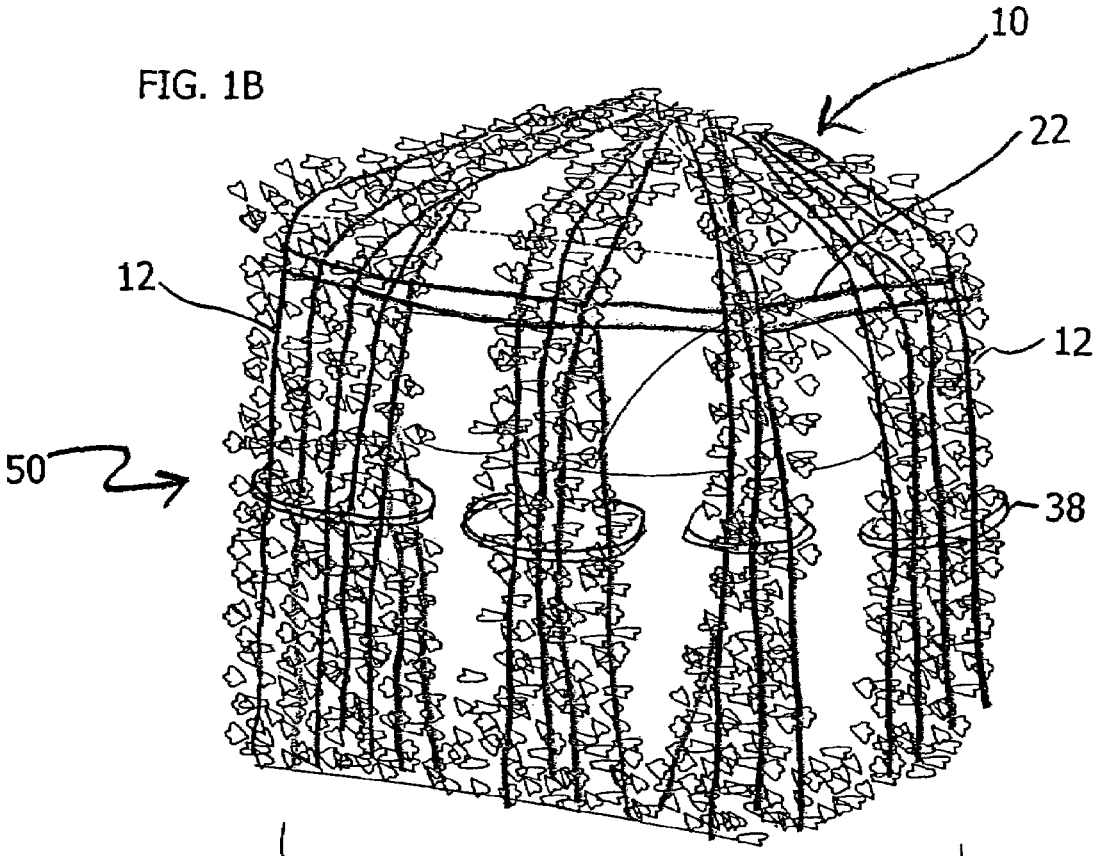
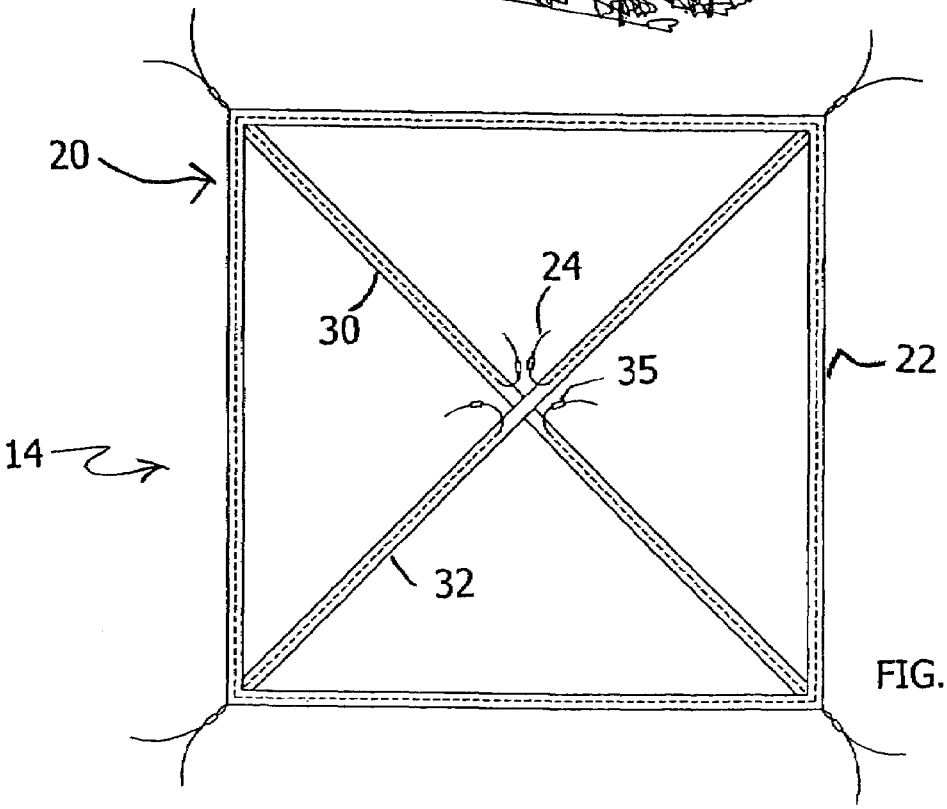
FIG. 2

UNIVERSAL 3-D CAMOUFLAGE STRIPS WITH NATURE EFFECTS, CAMOUFLAGE COVER FORMED THEREFROM, AND OUTDOOR ENCLOSURE INCORPORATING SAME

CROSS-REFERENCE TO RELATED APPLICATION

This application is a continuation-in-part of, and claims priority under 35 USC 120 from pending U.S. patent application Ser. No. 10/956,378, filed on Oct. 1, 2004, which itself claims priority from a provisional application having Ser. No. 60,507,774 filed on Oct. 1, 2003.

BACKGROUND OF THE INVENTION

1. Field of the Invention

The present invention relates to concealment-enhancing accessories for use in conjunction with portable shelters and similar outdoor enclosures, for providing a hidden location for a hunter or naturalist to occupy in the field while observing or waiting for game or other wildlife. More particularly, the present invention relates to an adjustable covering for an outdoor enclosure such as a tent or hunting blind, in which the covering includes three-dimensional nature effects, and is made adjustable to fit over numerous styles, shapes and sizes of outdoor enclosures.

2. Description of the Background Art

When out in the field for moderate or long periods, hunters often spend time in hunting blinds to disguise themselves from game, and also to protect themselves from inclement weather. However, a problem arises because the hunting blind or shelter is an unnatural object, and its unusual shape and colors tend to make it stand out when viewed by game. As a result, game generally avoids the blind or shelter, and the hunter's position is compromised.

Similarly, naturalists, nature photographers, and environmental scientists often work out in the field, such as in forest or wilderness areas. Naturalists often wish to approach and view wild animals as closely as possible without being detected, in order to photograph or observe the animals in their natural habitat, while disturbing them as little as possible. Accordingly, these people also find it useful to disguise their presence while also being sheltered from the elements of nature.

Many designs for hunting blinds are known. Class 135, subclass 901 is provided in the U.S. Patent Classification System for the listing of hunting blinds and ice fishing shelters.

Adams, U.S. Pat. No. 6,009,673 discloses a portable insulated modular shelter, which is usable as a hunting blind, ice fishing shelter, or wildlife observatory. Several other known designs for hunting blinds, ice fishing shelters and similar enclosures are referred to and discussed in the background section of the Adams '673 reference.

It is further recognized in the art that camouflage material having three-dimensional elements are very effective in breaking up hard lines and corners which are artificial to a natural environment. Several patents employing various types of three-dimensional camouflage exist. The following patents demonstrate various implementations of three-dimensional camouflage.

U.S. Pat. No. 4,517,230, entitled Artificial Camouflage Leaf Construction, granted to Crawford discloses a camouflage system in which simulated leaves are attached to an elongated flexible strip of material, and these leafy strips of material are attached in turn to an outdoorsman's clothes.

U.S. Pat. No. 4,792,471, entitled Body Wrap Camouflage Strip For Hunters, granted to Lee discloses a camouflage system in which simulated foliage is removably attached to an elongated flexible strip of material. It is envisioned that one long strip of this flexible material would be wrapped in multiple loops about a person.

U.S. Pat. No. 6,060,142, entitled Universal Three-Dimensional Camouflage System, granted to Rossini discloses simple three-dimensional elements that can be attached to any piece of clothing or structure in order to provide a degree of camouflage. A plurality of fabric strands having varying lengths are attached at their midpoints to an alligator clip. Any number of these attachments can be applied to any surface capable of being engaged by an alligator clip.

Although the known devices provide some utility for their intended purposes, a need still exists in the art for an improved three-dimensional camouflage covering that can be used with any number of outdoor enclosures by adapting to the structural, window, and door features of the enclosure.

SUMMARY OF THE INVENTION

The present invention provides a camouflage cover apparatus for use in conjunction with an outdoor enclosure. The cover apparatus hereof effectively provides a concealing cover to an outdoor enclosure and occupant in the field. A cover according to the present invention provides a nature-effect camouflage curtain having three-dimensional features thereon which simulate leaves or other foliage. The three-dimensional nature effects break up the silhouette of the concealed structure, so that hard lines and corners become softened and obscured.

Only in recent times have commercial blinds been produced with three-dimensional camouflage. As such, one object of this invention is to provide a universal camouflage cover that can be applied to numerous shapes and sizes of outdoor enclosures, for the purpose of providing enhanced camouflage.

Given the great diversity of outdoor enclosure designs, any cover designed for retrofitting enclosures with three-dimensional camouflage would benefit from an adjustment mechanism. Enclosures can have regular shapes such as domes, cubes, or pyramids, as well as irregular shapes formed from spring steel frames. Having a single cover that could adapt to any one of these shapes would be the most cost-effective from a manufacturing standpoint. The camouflage cover hereof may include have adjustable straps and tie backs that allow the cover to adapt to a structure, and allow for some flexibility by in use.

In a first embodiment of the invention, a camouflage cover is formed from a plurality of vertical concealment elements joined together at a central location. These vertical elements can be horizontally spread apart to accommodate windows or door openings of the structure being concealed.

Given the great diversity of outdoor enclosure designs, any cover designed for retrofitting enclosures with three-dimensional camouflage would benefit from an adjustment mechanism. Enclosures can have regular shapes such as domes, cubes, or pyramids, as well as irregular shapes formed from spring steel frames. Having a single cover that could adapt to any one of these shapes would be the most cost-effective from a manufacturing standpoint. The camouflage cover hereof may include adjustable straps and tie backs that allow the cover to adapt to a structure, and allow for some flexibility thereby in use.

Hunting conditions vary according to the environment, season, and geographic location. A camouflage blind that is colored to blend in with green foliage would stand out to the point of being useless in an open field or fall foliage environment. While some hunting blinds have varying camouflage schemes that can be attached to match the respective environment, most blinds come with a fixed camouflage scheme. Accordingly, a camouflage cover according to another embodiment of the present invention may enable hunting blinds that don't have the ability to change their camouflage scheme to nonetheless be useful in a non-conforming environment though the application of a camouflage cover having the appropriate camouflage scheme.

While this invention provides a high degree of concealment, adding additional nature effects may be advantageous in some circumstances. As such, in another embodiment of the present invention, structure is provided to permit a user to attach additional real or simulated nature effects. Accordingly, fabric loops may be provided in the nature-effect strands so that real or simulated twigs, branches, grasses, or leaves can be temporarily attached thereto.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 1B is a perspective view of a hunting blind enclosure with a camouflage cover installed thereon, and with the cover arranged to enable visibility out of windows of the enclosure.

FIG. 2 is a top plan detail view of a webbing frame which is part of the camouflage cover of FIG. 1, in which nature-effect strands have been deleted from the drawing for purposes of illustration, and showing interwoven cord and cord locks.

DETAILED DESCRIPTION OF ILLUSTRATIVE EMBODIMENTS

Figure 1A:
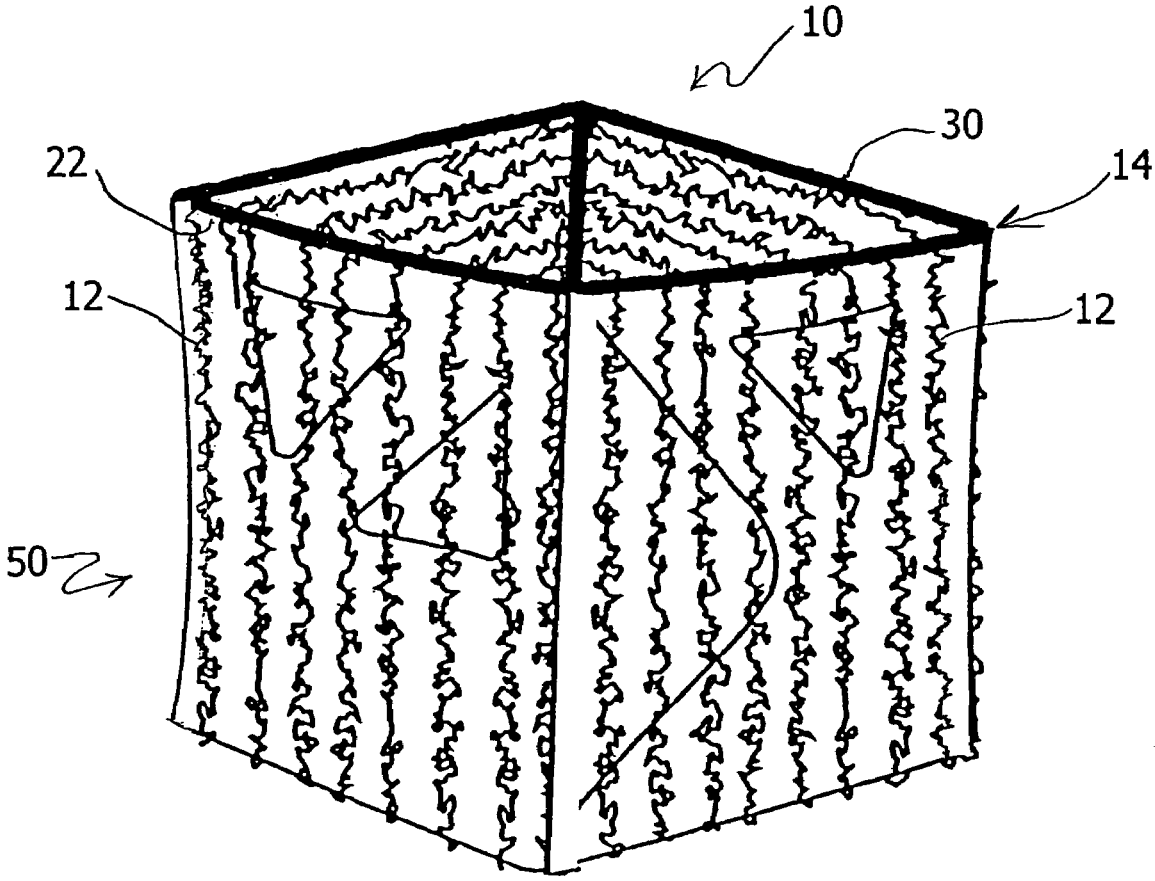
FIG. 1A is a simplified perspective view of a hunting blind enclosure with a camouflage cover according to an illustrative embodiment of the present invention fitted over the enclosure.

Referring now to FIG. 1A-1B, a camouflage cover in accordance with a first illustrative embodiment of the invention is shown generally at 10, installed on an outdoor enclosure 50. The camouflage cover 10 is provided for use in conjunction with an outdoor enclosure 50 such as a tent or hunting blind. In the illustrative embodiment shown in the drawings, the camouflage cover 10 includes support straps, adjustment cords, nature-effect strands 12, tiebacks, and nature effects attachment loops. Each of these components will be described in further detail below.

In FIG. 1A, the nature-effect strands 12 are shown in simplified schematic form to illustrate the substantially vertical orientation thereof, and are not curtained together by the optional tieback connectors. In FIG. 1B, the tieback connectors are shown grouping the nature-effect strands 12 together, and the leafy structure of the strands is shown in greater detail.

Webbing Frame

FIG. 2 is a top plan detail view of a webbing frame 14 which is a component part of the camouflage cover 10 of FIGS. 1A and 1B. The nature-effect strands 12 have been deleted from the drawing of FIG. 2, for purposes of clarity in illustration.

The webbing frame 14 includes a plurality of strips of a strong flexible material such as woven nylon or other polymeric webbing or strapping, arranged in a pattern that is adapted to fit on top of an outdoor enclosure 50. The webbing frame 14 is provided to support the nature-effect strands 12. Collectively, the straps making up the webbing frame 14 are known as the support straps 20. In the disclosed embodiment, three support straps are operatively attached to one another.

A medial strap member 22 extends around the upper circumference of the enclosure 50 to form a loop, shown as a square in FIG. 2, and the two ends of this medial strap member 22 are fastened together.

Two upper strap members 30, 32 extend diagonally from the corners of the square and intersect at the center to form an X-shape, enclosed within the square. In the disclosed embodiment, these strips are affixed to each other with stitching, however other suitable fastening hardware such as riveting could be employed for this purpose.

Tightening Cords and Cord Locks

The camouflage cover 10 of this invention provides a universal cover that can be adjusted to fit any number of outdoor enclosures of different shapes and sizes. Accordingly, the support straps 20 of the webbing frame 14 include adjustment cords 24 that allow for the straps to be tightened or loosened. In the disclosed embodiment, there are numerous adjustment cords 24 provided. Four cords act, respectively, on the four sections of the two diagonally crossed strap members 30, 32. The medial strap member 22 has four sections, and each of these sections has an adjustment cord 24. Each of the adjustment cords 24 is provided with a spring-loaded cord lock provided 35 on one or both ends thereof.

All eight of the cords 24 have two ends, and one end of each cord may be fixedly attached to its respective support strap section. Each strap member 20 has a plurality of holes formed therethrough, disposed along a longitudinal centerline of the strap, and spaced at a substantially equal distance apart. For additional durability, if desired, each hole can be fitted with a metal or plastic grommet.

Figure 4:
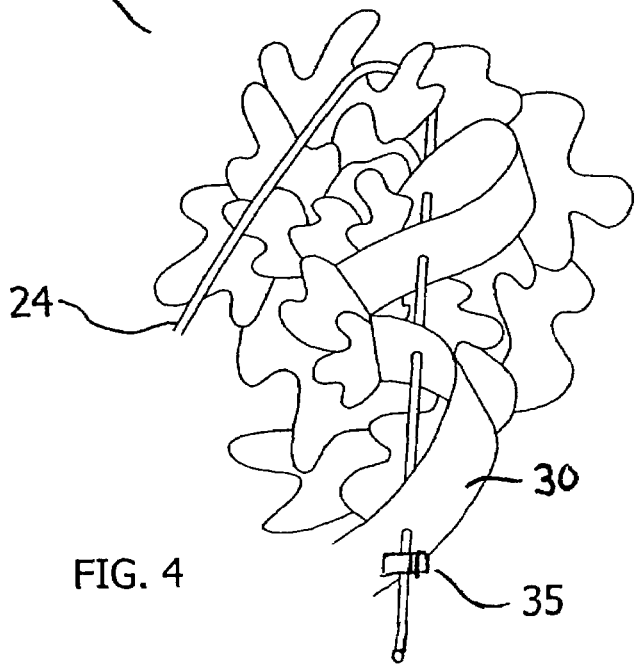
FIG. 4 is close up detail view of one segment of webbing with the adjustment cord tightened.
Figure 5:
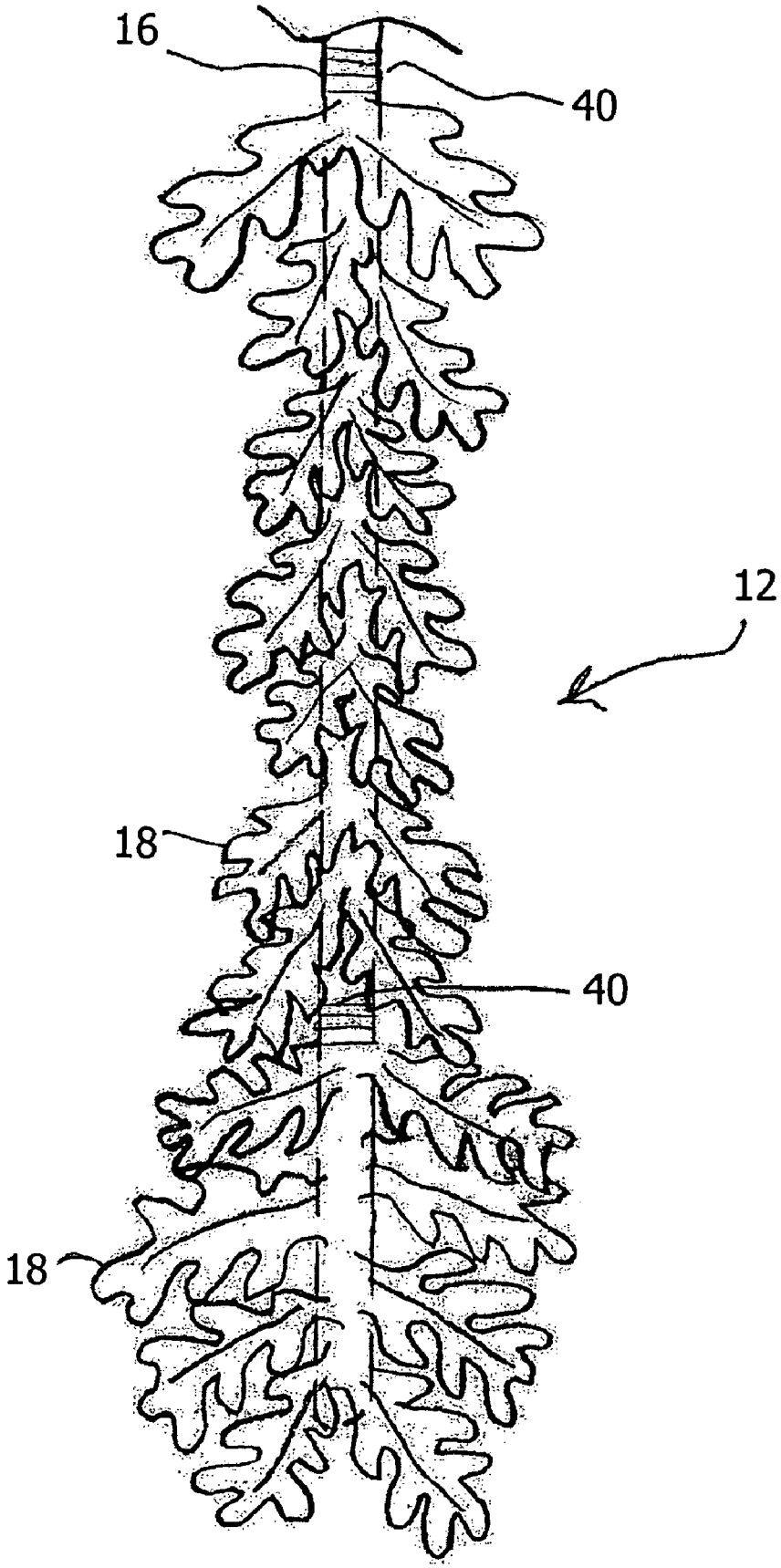
FIG. 5 is a close up of a single nature-effect strand showing simulated foliage extending outwardly at various random angles thereon.
Figure 6:
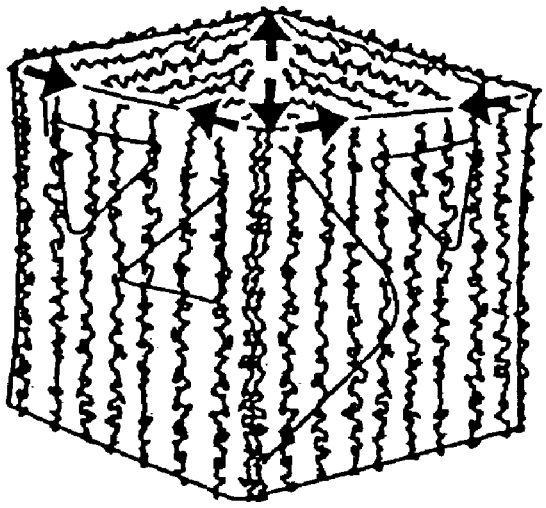
FIG. 6 is a perspective view of a hunting blind enclosure with a camouflage cover similar to FIG. 1A, with arrows thereon to show a direction of adjustment of a webbing frame component of the camouflage cover.

In the disclosed embodiment, each cord 24 of the upper strap members 30, 32 is attached at a respective endpoint of the X shape, and woven through the plurality of centerline holes until the center of the X is reached. The cord 24 is repeatedly woven back and forth through its associated strap member, extending from a first surface of the strap member to the second surface, and then continues through the next hole back to the first surface. As the cord 24 is pulled taught, the respective strap member slides along the cord and can become linearly compressed, visually appearing wavelike, as shown in FIG. 4. This shortens the effective length of the strap member, as suggested by the arrows in FIG. 6, allowing the cover 10 to be adjusted to fit on smaller blinds.

As seen best in FIG. 4, each cord 24 has at least one cord lock 35 adjustably attached to an end portion thereof. Such a cord lock 35 can be any one of a number of available devices that crimp or otherwise prevent a cord 24 from passing through a strap hole, thereby controlling the effective length of the cord to which the respective strap member is operatively connected. Each cord lock 35 that is attached to a cord 24 acting on a upper strap member slides toward the loose end of the cord to loosen the strap, and likewise, slides inwardly on the cord to tighten the strap.

In the disclosed embodiment, each corner of the medial strap member has two cords that are affixed at the midpoint of the strap and extend along the strap to the corner. Each edge member has holes along its centerline for slidably interacting with the tightening cords. The loose ends of the tightening cords 24 are woven repeatedly between the first and second surface of the respective medial strap member until the corner is reached. The exposed loose ends of the cords 24 from two adjacent medial strap sections are coupled together though a single corner cord lock, such that the eight edge member tightening cords are controlled by only four corner cord locks.

For a cover that attaches more tightly to the sides of the enclosure, elastic cord can be substituted for the nylon or polymeric cord that is otherwise used, extending through the holes of the support straps.

Nature-Effect Strands

Figure 3:
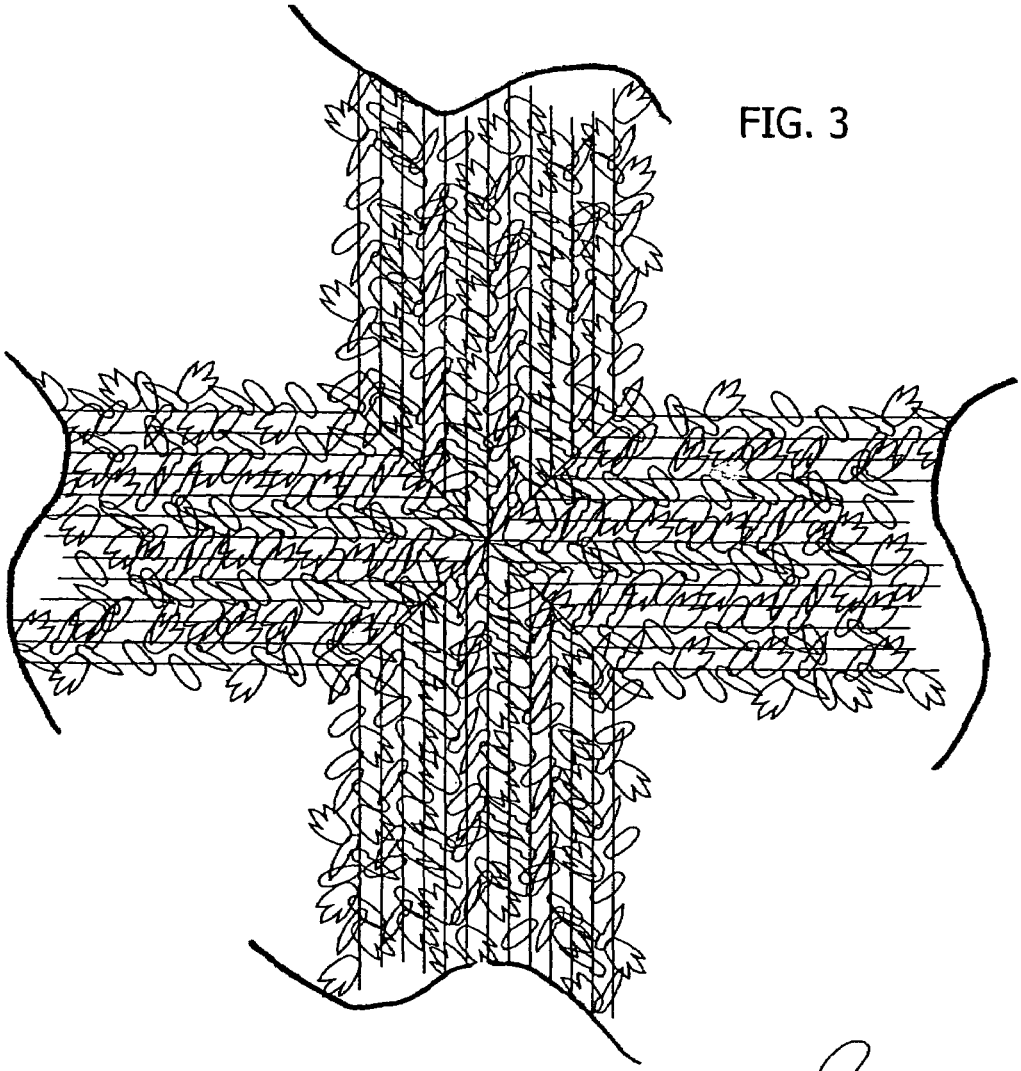
FIG. 3 is a top plan detail view showing a central portion of the cover of FIG. 1, spread out on a flat surface, and showing the nature-effect strands extending out in four directions from a central portion.

The nature-effect strands 12 are attached to the webbing frame 14 to provide the three-dimensional camouflage of the cover. With reference to FIG. 3, it will be understood that each of the nature-effect strands 12 is attached to a respective particular portion of the webbing frame 14 at a respective attachment point, with the attachment points arranged in a generally X-shaped pattern, as shown, generally following the contours of the upper strap members 30, 32. The cover 10 comprises a plurality of substantially parallel nature-effect strands 12 that extend substantially vertically downwardly over the side surfaces of the enclosure being concealed, in the installed orientation of the cover. These elongated nature-effect strands 12 contain fabric attachments that mimic natural shapes such as leaves. The disclosed embodiment employs nature-effect strands 12 that are held together by an elongated support strip 16 made of fabric or webbing. A plurality of die-cut artificial leaves 18 are attached by stitching to the support strip 16 along the longitudinal centerline thereof. The leaf-shaped cutouts 18 form a three-dimensional cover for the outdoor enclosure 50, since the nature-effect strands 12 can dangle and extend outwardly from the enclosure in a way that mimics natural foliage. This dangling provides a degree of randomness that realistically mimics leaves that naturally hang from tree branches. Other possible embodiments include a webbing strip or cord with artificial foliage branches extending therefrom, in a fashion somewhat reminiscent of a Christmas wreath or holly garland.

Tiebacks

Figure 7:
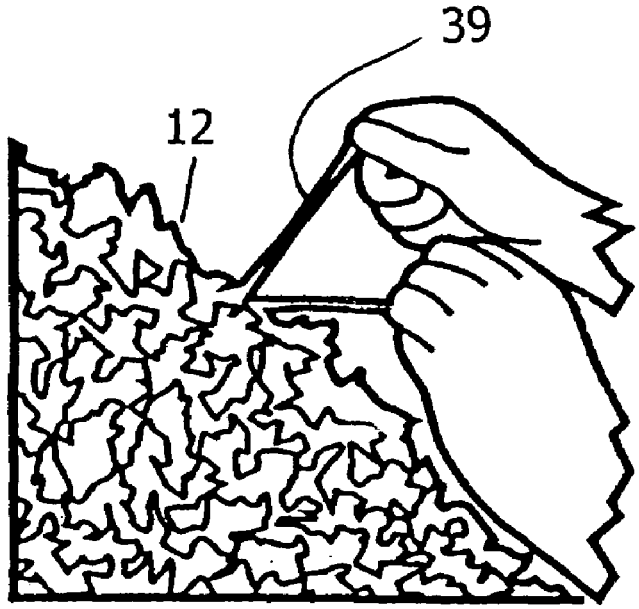
FIG. 7 is a perspective view showing an alternative version of a tiedown for organizing and grouping strands of the cover hereof.

On certain types of enclosures, tiebacks 38 can be useful for preventing the nature-effect strands from covering windows and ingress/egress openings. Tiebacks can take a number of forms. In the disclosed embodiment, the tiebacks 38 are fabric strips having hook and loop fastening material at the ends thereof. In use, the tieback straps 38 can be wrapped around a number of nature-effect strands, so that they can be moved and positioned in unison, and may be drawn away from a window or door opening as needed, as illustrated in FIG. 2B. FIG. 7 illustrates another type of tieback 39, which is simply a string which is manually tied around a grouping of nature-effect strands 12.

Another embodiment of tiebacks (not shown) involves adding one or more horizontal elements that completely encircle the outdoor enclosure. These horizontal elements, normally comprising elastic cord, would tightly extend over the nature-effect strands and pin them against the surface of the enclosure. In this arrangement, the strands could be adjusted horizontally and then be held in place by the horizontal members.

Additional Nature Effects

Even with the realistic camouflage provided by the nature-effect strands, there may be times when additional camouflage is desired. Such additional camouflage could come from either real or simulated natural elements such has grasses, tree leaves, and tree branches. Accordingly, the nature-effect strands may, optionally, have loops 40 disposed along their length for receiving and holding any additional user-selected nature effects that might be desired. In one embodiment, the loops 40 are additional pieces of separate elasticized fabric that are sewn on in a loop shape, and attached to a nature effects strand. Alternatively, rather than attaching additional fabric, gaps can be left in the stitching that connects the two different pieces of material that form a nature effects strand 12. In this arrangement, additional nature effects may be inserted in between the stitching gaps.

Other Embodiments

A second embodiment discloses a camouflage cover designed to fit over a cone or teepee shaped enclosure. In this embodiment, one end of each of the nature-effect strands are connected together at a central point. The opposite ends extend out radially from the center. A circular support strap is fixedly attached to the nature-effect strands. Radial support straps extend from the central point to the circular support strap. This embodiment would be similar to that shown, except that the square medial strap member 22 shown in FIG. 2 would be replaced by a circular medial strap member. If the material used for the webbing frame 14 is sufficiently flexible, a single cover apparatus 10 could be adaptable to fit on either shape of blind.

A third embodiment discloses a simplified construction of the first embodiment. As shown in FIG. 3, this embodiment requires more nature effects strand material, but reduces the labor involved in construction. A plurality of nature-effect strands are laid in parallel to form a first set of nature-effect strands. A second set of nature-effect strands also laid in parallel are fixedly attached to the first set in a perpendicular arrangement. This arrangement creates five distinct areas. There is a central area that would cover the roof of the enclosure in which the strands form a grid. Four sections of parallel strands extend outwardly in four different directions form this central area. Each of these four sections would cover a respective sidewall of a cube shaped enclosure.

Support straps having a similar configuration to that disclosed in the first embodiment could be employed to make this embodiment adjustable.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. A camouflage cover for use in conjunction with an outdoor enclosure, said camouflage cover comprising:

an enclosure adaptor frame configured to adapt the cover to a structural feature of the enclosure, including:

at least one strap member, and at least one adjustment element operably connected to the at least one strap member; and a plurality of nature-effect strands attached to the adaptor frame, each strand including:

an attachment point attaching the strand to the adaptor frame, and at least one free end extending from the attachment point, wherein each of said nature-effect strands comprises an elongated strip of material having artificial foliage attached thereto.

2. A camouflage cover as described in claim 1, wherein each of said nature-effect strands comprises an elongated strip of woven material, and a plurality of foliage-shaped cutout sections disposed along each edge of said strip.

3. A camouflage cover as described in claim 1, wherein said nature-effect strands are provided with a camouflage color scheme.

4. A camouflage cover as described in claim 1, wherein the at least one adjustment element includes at least one adjustment cord interlaced with the at least one strap member and a cord lock operably connected to each of the at least one adjustment cords to adjust the length of the corresponding strap member.

5. A camouflage cover as described in claim 1, further comprising a plurality of tieback connectors operatively associated with said nature-effect strands.

6. A camouflage cover as described in claim 1, wherein said nature-effect strands further comprise a plurality of loops attached to the elongated strip of material thereof, for optionally receiving and holding additional user-selected camouflage materials.

7. The camouflage cover according to claim 1, wherein the at least one strap member includes a medial strap and at least one upper strap having ends thereof attached to the medial strap.

8. The camouflage cover according to claim 1, wherein the at least one strap member includes a plurality of interconnected strap members having strap segments disposed between strap interconnection points.

9. The camouflage cover according to claim 8 wherein the at least one adjustment element includes an independently adjustable adjustment cord interlaced with a corresponding strap segment and an operably connected cord lock.

10. The camouflage cover according to claim 9, wherein each adjustment cord includes a first end fixedly attached to the corresponding strap segment and a free end associated with the cord lock, and wherein the length of the corresponding strap may be adjusted between at least a first length and a second length by altering the lateral position of the cord lock along the adjustment cord.

11. A camouflage system comprising:

a human-occupiable outdoor enclosure; and a removably attached camouflage cover attached thereto, the cover including:

an enclosure adaptor frame configured to adapt the cover to a structural feature of the enclosure, including:

one or more interconnected support straps, and at least one adjustment element operably connected to the support straps; and a plurality of nature-effect strands, each strand having an attachment point fixedly attaching the strand to the adaptor frame and at least one free end extending from the attachment point;

each of said nature-effect strands comprising one or more elongated strips of material having a plurality of pieces of artificial foliage attached thereto.

12. The camouflage system as described in claim 11, wherein said nature-effect strands are provided with a camouflage color scheme.

13. The camouflage system as described in claim 11, wherein the at least one adjustment element includes at least one adjustment cord interlaced with each of the support straps and a cord lock operably connected to each of the at least one adjustment cords to adjust the length of the corresponding support strap.

14. The camouflage system as described in claim 11, further comprising a plurality of tieback connectors operatively associated with said nature-effect strands.

15. A method of using a human-occupiable outdoor enclosure, comprising:

erecting the outdoor enclosure; and concealing the outdoor enclosure with a camouflage cover having:

an enclosure adaptor frame, including:

at least one strap member, and at least one adjustment element operably connected to the at least one strap member, each adjustment element of the at least one adjustment element includes an independently adjustable adjustment cord interlaced with a corresponding strap segment and an opperably connected cord lock; and a plurality of nature-effect strands attached to the adaptor frame, each strand including:

an attachment point attaching the strand to the adaptor frame, and at least one free end extending from the attachment point, wherein each of said nature-effect strands comprises an elongated strip of material having artificial foliage attached thereto.

16. The method according to claim 15, further comprising adapting the enclosure adaptor frame to correspond to a structural feature of the enclosure.

17. The method according to claim 16, further comprising laterally repositioning the cord lock of at least one adjustment element along the length of the corresponding adjustment cord.

18. The method according to claim 17, further comprising revealing the enclosure including:

loosening the adaptor frame; and removing the camouflage covering.

* * * * *